US007821777B2

(12) United States Patent
Chih

(10) Patent No.: US 7,821,777 B2
(45) Date of Patent: Oct. 26, 2010

(54) MULTIFUNCTION BASE AND COMPUTER UTILIZING THE SAME

(75) Inventor: Ting-Hui Chih, Hualien (TW)

(73) Assignee: Qisda Corporation, Taoyuan County (TW)

( * ) Notice: Subject to any disclaimer, the term of this patent is extended or adjusted under 35 U.S.C. 154(b) by 1079 days.

(21) Appl. No.: 11/520,143

(22) Filed: Sep. 12, 2006

(65) Prior Publication Data

US 2007/0056866 A1 Mar. 15, 2007

(30) Foreign Application Priority Data

Sep. 14, 2005 (TW) ..... 94131607 A

(51) Int. Cl.
*H05K 5/00* (2006.01)
*B65D 5/52* (2006.01)
*G06F 1/16* (2006.01)

(52) U.S. Cl. ..... 361/679.01; 206/45.2; 361/679.21; 361/679.29; 361/679.58; 361/679.59

(58) Field of Classification Search .....
361/679.01–679.03, 679.31–679.4, 679.55, 361/679.58, 724–727, 683, 684, 685, 686; 312/331; 248/560, 621, 221.3, 638, 619; 439/157, 60, 152–153, 327, 328, 331
See application file for complete search history.

(56) References Cited

U.S. PATENT DOCUMENTS 5,295,648 A * 3/1994 Hames ..... 248/149
6,561,349 B2 * 5/2003 Lee ..... 206/320
2007/0158510 A1 * 7/2007 Jung ..... 248/176.1

* cited by examiner

*Primary Examiner*—Jayprakash N Gandhi
*Assistant Examiner*—Jerry Wu

(57) ABSTRACT

A multifunction base and a computer utilizing the same. The multifunction base is applicable to an electronic device, and comprises a first portion and a second portion. The second portion is detachably combined with the first portion. When the second portion and the first portion are combined, they be utilized as a base for the electronic device. When the second portion and the first portion are separated, the electronic device can be received in the first and second portions.

21 Claims, 6 Drawing Sheets

100

MULTIFUNCTION BASE AND COMPUTER UTILIZING THE SAME

BACKGROUND OF THE INVENTION

1. Field of the Invention

The present invention relates to a multifunction base and a computer utilizing the same, and in particular to a multifunction base that may be used as a packing material.

2. Description of the Related Art

When transporting electronic devices, a large amount of packing material is utilized for protection. After transport, the packing material is typically discarded, which is harmful to the environment.

BRIEF SUMMARY OF THE INVENTION

Multifunction bases are provided. An exemplary embodiment of a multifunction base is applied to an electronic device, and comprises a first portion and a second portion. The second portion is detachably combined with the first portion. When the second portion and the first portion are combined, the first portion and the second portion can be utilized as a base for the electronic device. When the second portion and the first portion are separated, the electronic device can be received in the first portion and the second portion.

Furthermore, the first portion comprises a first body, a first cushion member, a support, a circuit board, a power wire, a signal wire, and a bottom cover. The first cushion member is disposed in the first body, and comprises foam material or polyethylene When the electronic device is received in the first portion, the electronic device abuts the first cushion member. The support is connected to the first body in a manner such that the support is moveable between a first position and a second position. When the electronic device is received in the first portion, the support is in the first position. When the second portion and the first portion are combined, the support is in the second position to be connected to the electronic device. The first body comprises a groove, and the support comprises a protrusion located in the groove. The support is moveable between the first position and the second position by moving the protrusion in the groove. The circuit board is disposed in the first body. When the second portion and the first portion are combined, the electronic device is electrically connected to the circuit board. The power wire is electrically connected to the circuit board. The signal wire is electrically connected to the circuit board. The bottom cover is combined with the first body to receive the circuit board between the first body and the bottom cover.

Moreover, the second portion comprises a second body, a second cushion member, and a support. The second cushion member is disposed in the second body, and comprises foam material or polyethylene. When the electronic device is received in the second portion, the electronic device abuts the second cushion member. The support is connected to the second body in a manner such that the support is moveable between a first position and a second position. When the electronic device is received in the second portion, the support is in the first position. When the second portion and the first portion are combined, the support is in the second position to be connected to the electronic device. The second body comprises a groove, and the support comprises a protrusion located in the groove. The support is moveable between the first position and the second position by the protrusion moving in the groove.

Additionally, the multifunction base further comprises a pin, the first body comprises a first hole, and the second body comprises a second hole corresponding to the first hole. The first portion is combined with the second portion by inserting the pin into the first hole and the second bole.

Computers are provided. An exemplary embodiment of a computer comprises a screen, a first portion, and a second portion. The second portion is detachably combined with the first portion. When the second portion and the first portion are combined, the first portion and the second portion can be utilized as a base for the screen. When the second portion and the first portion are separated, the screen can be received in the first portion and the second portion.

Furthermore, the computer comprises a connection wire, a host, and a host platen. When the second portion and the first portion are combined, the connection wire connects the screen and the circuit board, the host electrically connects the power wire and the signal wire, the host platen is combined with the second portion and the first portion, and the host is disposed on the host platen. When the second portion and the first portion are separated, the host platen is received in the second portion. The first body comprises a first lead hole, the second body comprises a second lead hole, and the host platen comprises a plurality of protrusions. The protrusions are inserted into the first lead hole and the second lead hole to combine the host platen with the first portion and the second portion when the second portion and the first portion are combined.

A detailed description is given in the following embodiments with reference to the accompanying drawings.

BRIEF DESCRIPTION OF THE DRAWINGS

The invention can be more fully understood by reading the subsequent detailed description and examples with references made to the accompanying drawings, wherein.

DETAILED DESCRIPTION OF THE INVENTION

Multifunction bases of the invention can be applied to any electronic device requiring a base. The following embodiment utilizes a computer as an example.

Figure 1A:
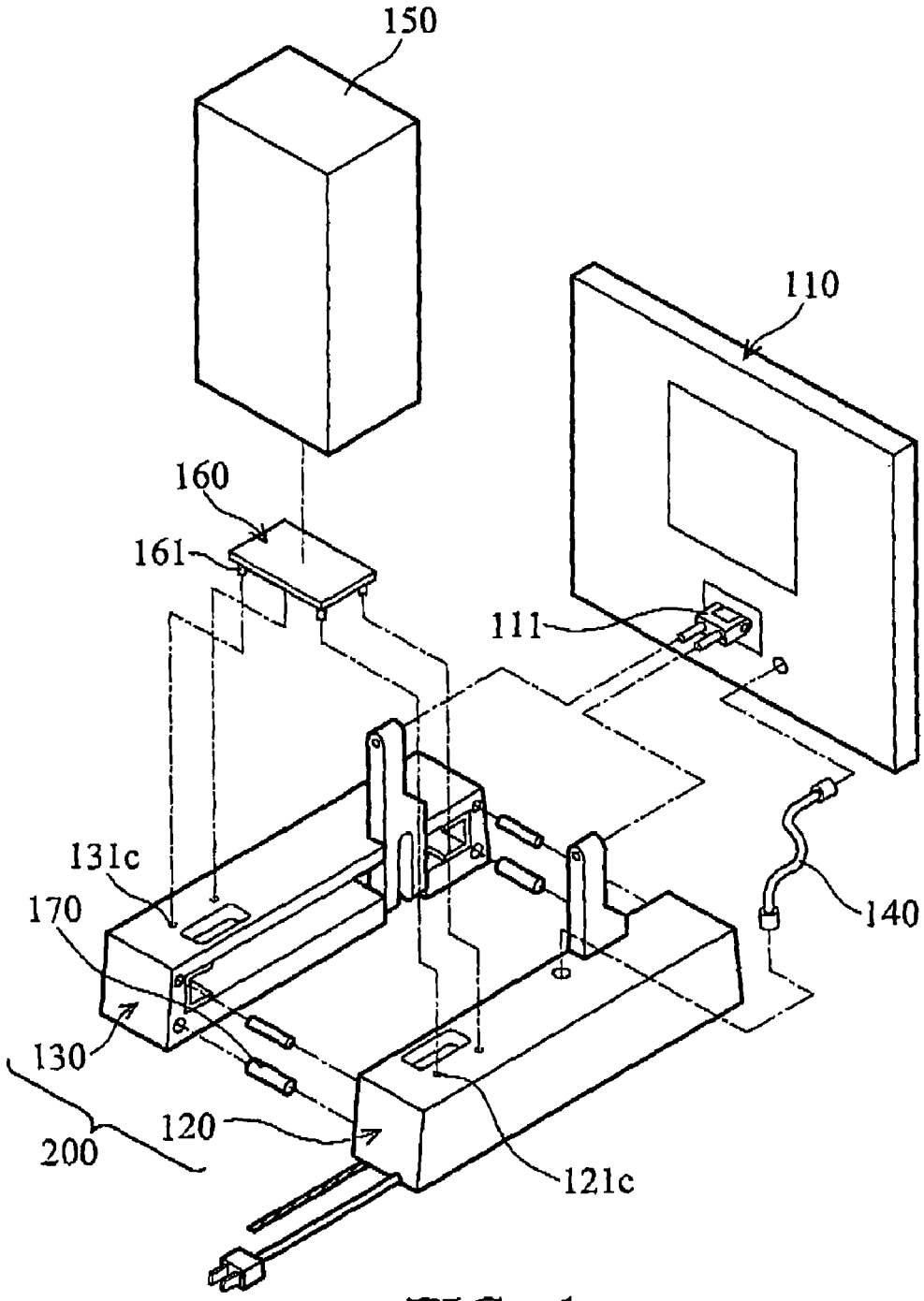
FIG. 1*a* is an exploded view of an embodiment of a computer.
Figure 1B:
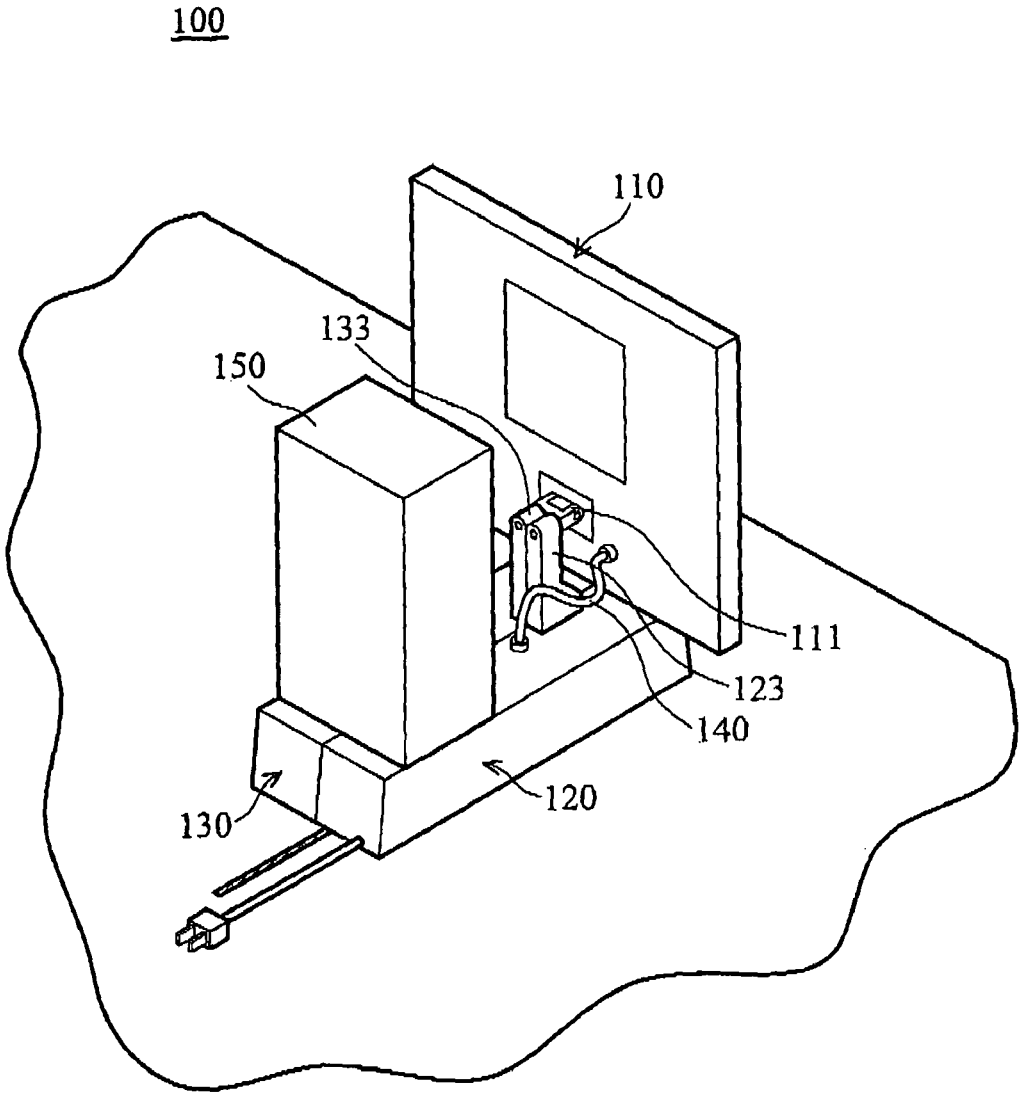
FIG. 1*b* is a schematic view of the assembled computer in FIG. 1*a;*

Referring to FIGS. 1*a* and 1*b*, an embodiment of a computer 100 comprises a screen 110, a first portion 120, a second portion 130, a connection wire 140, a host 150, a host platen 160, and four pins 170. The screen 110 is a display of the computer 100, and comprises a rotary shaft 111 at its back.

Figure 2A:
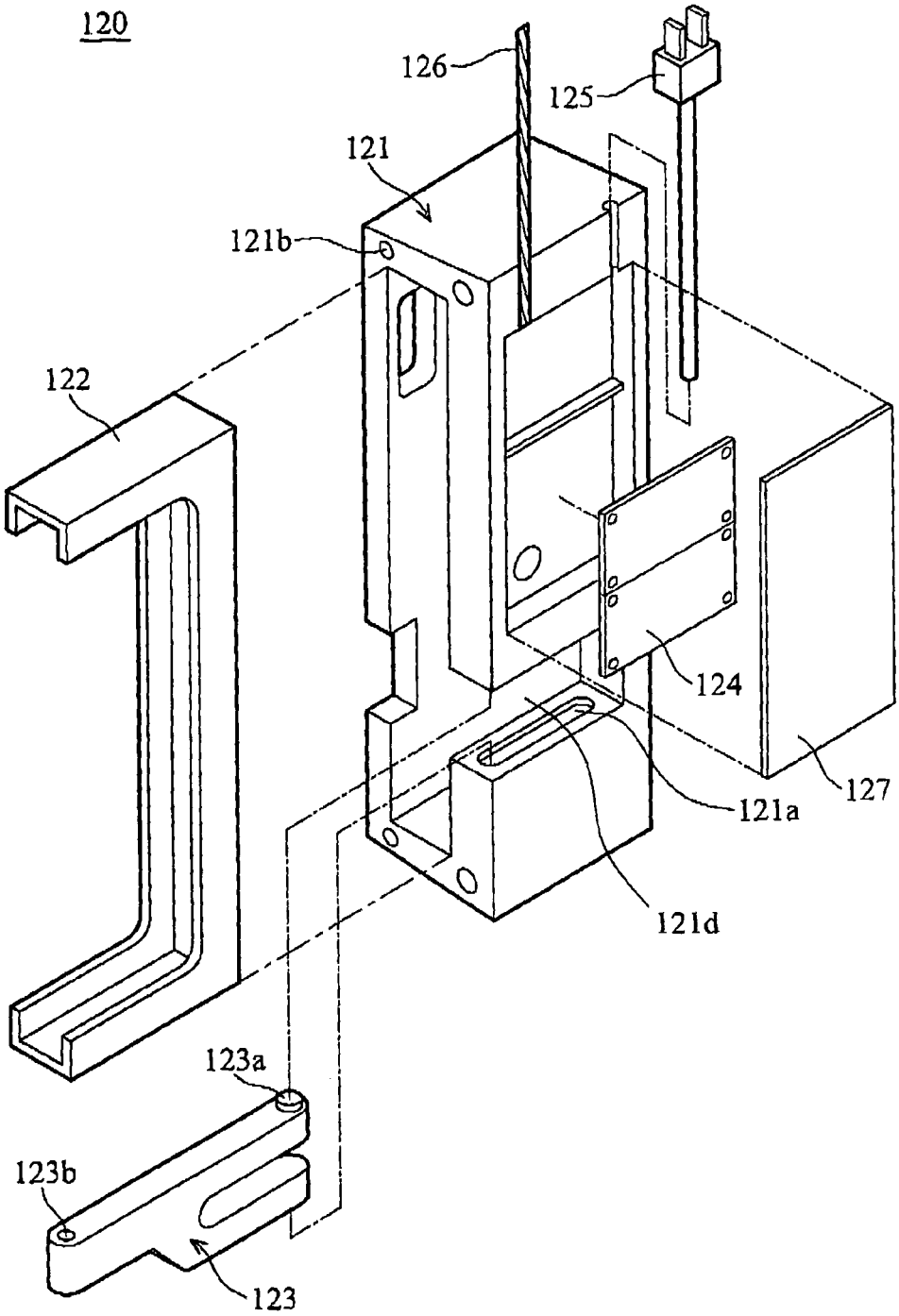
FIG. 2*a* is an exploded view of a first portion in FIG. 1*a;*

The first portion 120 and the second portion 130 constitute a multifunction base 200 of the invention. Referring to FIG. 2*a*, the first portion 120 comprises a first body 121, a first cushion member 122, a first support 123, a circuit board 124, a power wire 125, a signal wire 126, and a bottom cover 127. The first body 121 is formed with a notch 121*d* at its bottom. Two grooves 121*a* are formed around the notch 121*a*. Only one groove 121*a* is shown in FIG. 2*a*. The first body 121 further comprises four first holes 121*b* at a side facing the second portion 130, and two first lead holes 121*c* at its top, as shown in FIG. 1*a*.

Figure 3A:
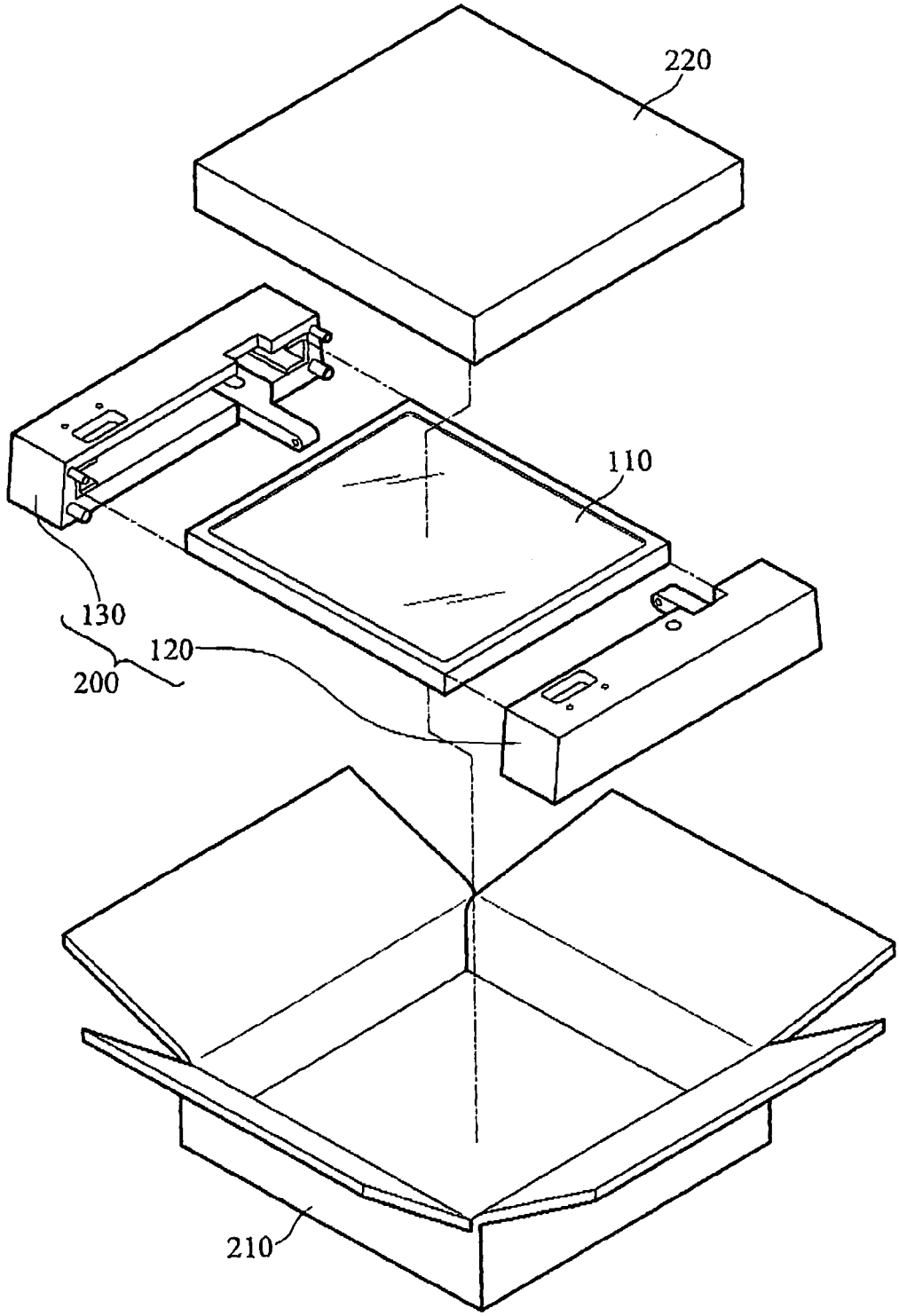
FIG. 3*a* is a schematic view of an embodiment of a multifunction base and other packing material for packaging an electronic device.

The first cushion member 122 is disposed in the first body 121, and may be preferably made of foam material or polyethylene. The first support 123 is connected to the first body 121 in a manner such that the first support 123 is moveable between a received position (as shown in FIG. 3*a* and hereinafter referred as a first position) and a supporting position (as shown in FIG. 1*a* and hereinafter referred as a second position). Specifically, when the electronic device such as the screen 110 is received in the first portion 120, the first support 123 is in the first position to be received in the notch 121*d* of the first body 121. When the second portion 130 and the first portion 120 are combined to form the base 200, the first support 123 is in the second position to be connected to the rotary shaft 111 of the screen 110. Additionally, the first support 123 comprises two protrusions 123*a* at one end, and a hole 123*b* at the other end. Only one protrusion 123*a* is shown in FIG. 2*a*. The protrusions 123*a* are located in the grooves 121*a* of the first body 121. The first support 123 is moveable between the first position and the second position by the protrusions 123*a* moving in the grooves 121*a*.

The circuit board 124 is disposed in the first body 121. When the second portion 130 and the first portion 120 are combined to form a base 200, the circuit board 124 is electrically connected to the screen 110 via the connection wire 140. Both the power wire 125 and the signal wire 126 are electrically connected to the circuit board 124 to transmit the required power and signal. The bottom cover 127 is combined with the first body 121 to receive the circuit board 124 between the first body 121 and the bottom cover 127.

Figure 2B:
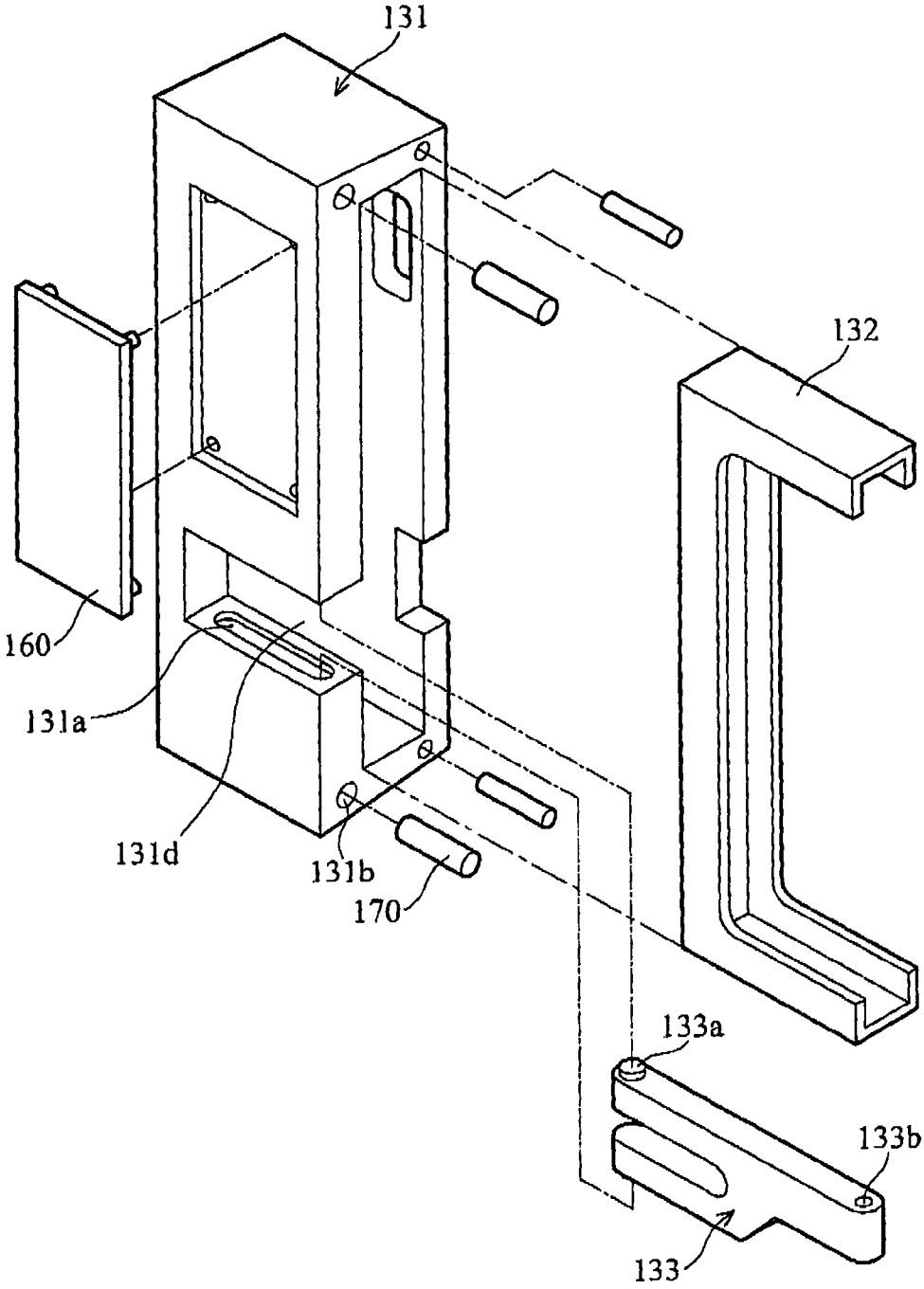
FIG. 2*b* is a an exploded view of a second portion in FIG. 1*a;*

The second portion 130 is detachably combined with the first portion 120. Referring to FIG. 2*b*, the second portion 130 comprises a second body 131, a second cushion member 132, and a second support 133. The second body 131 is formed with a notch 131*d* at its bottom. Two grooves 131*a* are formed around the notch 131*a*. Only one groove 131*a* is shown in FIG. 2*b*. The second body 131 further comprises four second holes 131*b* at a side facing the first portion 120, and two second lead holes 131*c* at its top as shown in FIG. 1*a*.

The second cushion member 132 is disposed in the second body 131, and may be preferably made of foam material or polyethylene. The second support 133 is connected to the second body 131 in a manner such that the second support 133 is moveable between the received position (as shown in FIG. 3*a* and hereinafter referred to as the first position) and the supporting position (as shown in FIG. 1*a* and hereinafter referred to as the second position). Specifically, when the electronic device such as the screen 110 is received in the second portion 130, the second support 133 is in the first position to be received in the notch 131*d* of the second body 131. When the second portion 130 and the first portion 120 are combined to form the base 200, the second support 133 is in the second position to be connected to the rotary shaft 111 of the screen 110. Additionally, the second support 133 comprises two protrusions 133*a* at one end, and a hole 133*b* at the other end. Note that only one protrusion 133*a* is shown in FIG. 2*b*. The protrusions 133*a* are located in the grooves 131*a* of the second body 131. The second support 133 is moveable between the first position and the second position by the protrusions 133*a* moving in the grooves 131*a*.

Figure 3B:
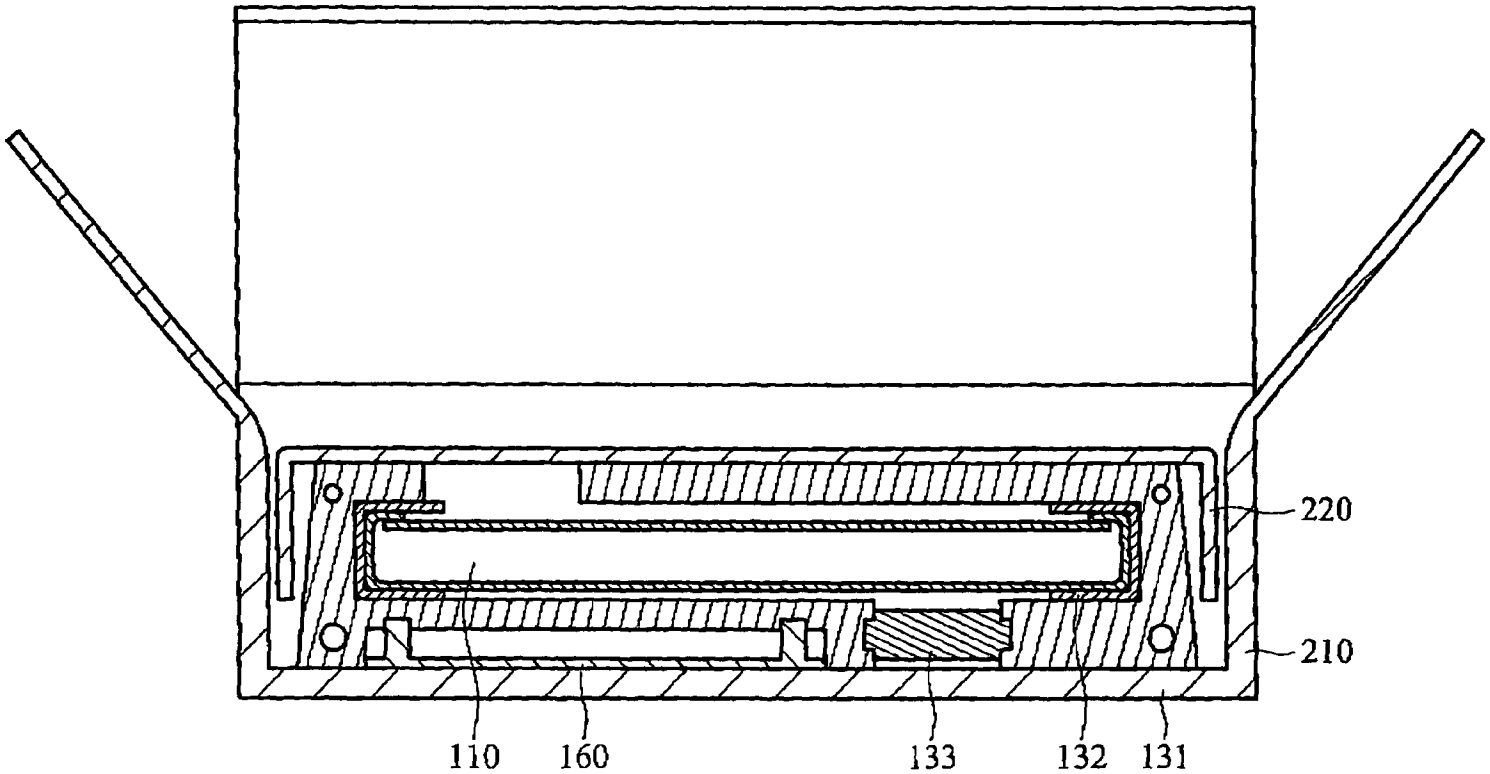
FIG. 3*b* is a partial cross section of the assembly of the multifunction base and the electronic device in FIG. 3*a*.

The connection wire 140 electrically connects the screen 110 and the circuit board 124 in the first portion 120 when the second portion 130 and the first portion 120 are combined to form the base 200. Note that the manner of connection between the screen 110 and the circuit board 124 is not limited to this. The host 150 electrically connects the power wire 125 and the signal wire 126 in the first portion 120. The host platen 160 is formed with four protrusions 161. When the second portion 130 and the first portion 120 are separated, the host platen 160 is received in the second portion 130, as shown in FIG. 3*b*. When the second portion 130 and the first portion 120 are combined to form the base 200, the protrusions 161 are inserted into the first lead holes 121*c* and the second lead holes 131*c* respectively so that the host platen 160 is combined with the second portion 130 and the first portion 120 and the host 150 is disposed on the host platen 160. Thus, by combining the host platen 160 with the first portion 120 and the second portion 130, the combination between the first portion 120 and the second portion 130 becomes more stable.

To combine the second portion 130 with the first portion 120, the pins 170 are inserted into the first holes 121*b* and the second hole 131*b* so as to form the base 200.

When the multifunction base 200 is used as a base for the screen 110, the first portion 120 and the second portion 130 are combined by the pins 170, as shown in FIG. 1*b*. When the multifunction base 200 is used as a packing material, the first portion 120 and the second portion 130 are separated and incorporated with a paper box 210 and packing material 220, as shown in FIG. 3*a*. Thus, the screen 110 can be received in the first portion 120, the second portion 130, the paper box 210, and the packing material 220. Furthermore, when the screen 110 is received in the first portion 120 and the second portion 130, the screen 110 abuts the first cushion member 122 and the second cushion member 132.

As previously described, since the multifunction base in this invention can serve as both base and packing material, it will not be discarded after unpacking, thus improving environment.

While the invention has been described by way of example and in terms of preferred embodiment, it is to be understood that the invention is not limited thereto. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A multifunction base applied to an electronic device, comprising:

a first portion, wherein the first portion comprises:

a first body;

a first cushion member disposed in the first body, wherein the electronic device abuts the first cushion member when the electronic device is received in the first portion; and a support connected to the first body in a manner such that the support is moveable between a first position and a second position, the support is in the first position when the electronic device is received in the first portion, and the support is in the second position to be connected to the electronic device when the second portion and the first portion are combined; and a second portion detachably combined with the first portion, wherein the first portion and the second portion can be utilized as a base for the electronic device when the second portion and the first portion are combined, and the electronic device can be received in the first portion and the second portion when the second portion and the first portion are separated.

2. The multifunction base as claimed in claim 1, wherein the first body comprises a groove, the support comprises a protrusion located in the groove, and the support is moveable between the first position and the second position by the protrusion moving in the groove.

3. The multifunction base as claimed in claim 1, wherein the first portion further comprises a circuit board disposed in the first body, and the electronic device is electrically connected to the circuit board when the second portion and the first portion are combined.

4. The multifunction base as claimed in claim 3, wherein the first portion further comprises:

a power wire electrically connected to the circuit board;

a signal wire electrically connected to the circuit board; and a bottom cover combined with the first body to receive the circuit board between the first body and the bottom cover.

5. The multifunction base as claimed in claim 1, wherein the second portion comprises.

a second body; and a second cushion member disposed in the second body, wherein the electronic device abuts the second cushion member when the electronic device is received in the second portion.

6. The multifunction base as claimed in claim 5, wherein the second portion further comprises a support connected to the second body in a manner such that the support is moveable between a first position and a second position, the support is in the first position when the electronic device is received in the second portion, and the support is in the second position to be connected to the electronic device when the second portion and the first portion are combined.

7. The multifunction base as claimed in claim 6, wherein the second body comprises a groove, the support comprises a protrusion located in the groove, and the support is moveable between the first position and the second position by the protrusion moving in the groove.

8. The multifunction base as claimed in claim 5, further comprising a pin, wherein the first body comprises a first hole, the second body comprises a second hole corresponding to the first hole, and the first portion and the second portion are combined by the pin inserting into the first hole and the second hole.

9. A computer comprising:

a screen;

a first portion, wherein the first portion comprises:

a first body;

a first cushion member disposed in the first body, wherein the screen abuts the first cushion member when the screen is received in the first portion; and a support connected to the first body in a manner such that the support is moveable between a first position and a second positions the support is in the first position when the screen is received in the first portion and the su ort is in the second position to be connected to the screen when the second portion and the first portion are combined; and a second portion detachably combined with the first portion, wherein the first portion and the second portion can be utilized as a base for the screen when the second portion and the first portion are combined, and the screen can be received in the first portion and the second portion when the second portion and the first portion are separated.

10. The computer as claimed in claim 9, wherein the first body comprises a groove, the support comprises a protrusion located in the groove, and the support is moveable between the first position and the second position by the protrusion moving in the groove.

11. The computer as claimed in claim 9, wherein the first portion further comprises a circuit board disposed in the first body, and the screen is electrically connected to the circuit board when the second portion is combined with the first portion.

12. The computer as claimed in claim 11, further comprising a connection wire to connect the screen and the circuit board when the second portion and the first portion are combined.

13. The computer as claimed in claim 11, wherein the first portion further comprises:

a power wire electrically connected to the circuit board;

a signal wire electrically connected to the circuit board; and a bottom cover combined with the first body to receive the circuit board between the first body and the bottom cover.

14. The computer as claimed in claim 13, further comprising a host electrically connecting the power wire and the signal wire when the second portion and the first portion are combined.

15. The computer as claimed in claim 11, wherein the second portion comprises:

a second body; and a second cushion member disposed in the second body, wherein the screen abuts the second cushion member when the screen is received in the second portion.

16. The computer as claimed in claim 15, wherein the second portion further comprises a support connected to the second body in a manner such that the support is moveable between a first position and a second position, the support is in the first position when the screen is received in the second portion, and the support is in the second position to be connected to the screen when the second portion and the first portion are combined.

17. The computer as claimed in claim 16, wherein the second body comprises a groove, the support comprises a protrusion located in the groove, and the support is moveable between the first position and the second position by the protrusion moving in the groove.

18. The computer as claimed in claim 15, further comprising a pin, wherein the first body comprises a first hole, the second body comprises a second hole corresponding to the first hole, and the first portion and the second portion are combined by the pin inserting into the first hole and the second hole.

19. The computer as claimed in claim 15, further comprising a host platen, wherein the host platen is received in the second portion when the second portion and the first portion are separated, and the host platen is combined with the second portion and the first portion when the second portion and the first portion are combined.

20. The computer as claimed in claim 19, wherein the first body comprises a first lead hole, the second body comprises a second lead hole, the host platen comprises a plurality of protrusions, and the protrusions are inserted into the first lead hole and the second lead hole to combine host platen with the first portion and the second portion when the second portion and the first portion are combined.

21. The computer as claimed in claim 19, further comprising a host disposed on the host platen when the second portion and the first portion are combined.

* * * * *